US008172387B2

(12) United States Patent
Wang et al.

(10) Patent No.: US 8,172,387 B2
(45) Date of Patent: May 8, 2012

(54) SUPPLY SYSTEM AND INJECTION-HEAD STRUCTURE THEREOF

(75) Inventors: Cheng-Yi Wang, Hsinchu County (TW); Wan-Wen Chiu, Hsinchu County (TW); Kuo-Hua Wu, Hsinchu Hsien (TW); Chen-Chu Tsai, Taichung County (TW); Chao-Kai Cheng, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 848 days.

(21) Appl. No.: 12/197,160

(22) Filed: Aug. 22, 2008

(65) Prior Publication Data

US 2009/0262165 A1 Oct. 22, 2009

(30) Foreign Application Priority Data

Apr. 18, 2008 (TW) ..... 97114206 A

(51) Int. Cl.
*B41J 2/19* (2006.01)

(52) U.S. Cl. ..... 347/92

(58) Field of Classification Search ..... 347/92
See application file for complete search history.

(56) References Cited

U.S. PATENT DOCUMENTS 4,948,427 A * 8/1990 Yamagishi et al. ..... 106/31.27
5,555,007 A * 9/1996 Ceschin et al. ..... 347/87
5,621,444 A * 4/1997 Beeson ..... 347/88
6,667,795 B2 12/2003 Shigemura
7,427,127 B2 * 9/2008 Ando et al. ..... 347/85
2005/0062818 A1 * 3/2005 Hashi et al. ..... 347/92

FOREIGN PATENT DOCUMENTS

JP 2001-527559 * 7/2001
TW I226288 1/2005
TW 200514740 5/2005
TW 200745619 12/2007

OTHER PUBLICATIONS

Taiwan Patent Office, Office Action—Notice of Allowance, Application Serial No. 097114206, Mar. 24, 2011, Taiwan.

* cited by examiner

*Primary Examiner* — Charlie Peng

(57) ABSTRACT

A supply system capable of providing a working fluid is provided. The supply system includes an access device, a first energizer, a second energizer, a third energizer and an output device. The access device utilized to access the working fluid includes a connecting port. The first energizer provides a first energy to energize the working fluid, thereby expelling the bubbles from the working fluid. The second energizer provides a second energy to energize the working fluid received in the access device, thereby expelling the working fluid through the connecting port of the access device. The output device is connected to the access device, thereby receiving and outputting the working fluid. The third energizer provides a third energy to heat the working fluid passing through the access device and the output device.

22 Claims, 8 Drawing Sheets

| measurement of dimensional variation of each head (mm) | | | | |
|---|---|---|---|---|
| variation / head | x1 | y1 | x128 | y128 |
| 40H4a | 0 | 0 | 0.019 | 0 |
| 40H3a | -0.007 | -0.002 | 0.017 | 0.001 |
| 40H2a | -0.007 | 0.003 | 0.026 | 0.003 |
| 40H1a | -0.002 | 0.013 | 0.028 | 0.014 |

SUPPLY SYSTEM AND INJECTION-HEAD STRUCTURE THEREOF

CROSS REFERENCE TO RELATED APPLICATIONS

This Application claims priority of Taiwan Patent Application No. 97114206, filed on Apr. 18, 2008, the entirety of which is incorporated by reference herein.

BACKGROUND OF THE INVENTION

1. Field of the Invention

The invention relates to a supply system, and more particularly to a supply system and an injection-head structure thereof to stably supply a working fluid.

2. Description of the Related Art

For ink-injection systems applied in manufacturing of displays or semiconductor products, quality of printing is influenced by bubbles in the ink. The bubbles are generated when the ink flows to the numerous and complicated regions and paths of the displays or semiconductor products and when the ink is stored within the regions and paths. Additionally, because ink is characterized with a basic viscosity, should bubbles in the ink influence ink flow, the stability of ink supply will decrease.

For example, U.S. Pat. No. 6,667,795 discloses a device for supplying fluid (ink) by fragmented sections (at least two chambers). '795 provides a main ink tank storing RGB inks, a thermal chamber, a media carry in/out, a panel XY stage, a panel tilt stage, a head unit, a head stage, a Z-directional detecting optical system, and a cleaning unit utilized to clean the cap and the blades which are embedded in each recovery unit.

However, treatment for bubbles contained in the fluid is not particularly disclosed by '795. Thus, when the fluid is supplied, bubbles generated in the fluid cannot be effectively expelled, thus, decreasing printing quality and stability of ink supply.

BRIEF SUMMARY OF THE INVENTION

The invention provides a supply system utilized to provide a working fluid. An embodiment of the supply system comprises an access device, a first energizer, a second energizer, an output device and a third energizer. The access device utilized to access the working fluid comprises a connecting port. The first energizer provides a first energy to energize the working fluid stored in the access device to expel bubbles from the working fluid. The second energizer provides a second energy to energize the working fluid stored in the access device to expel the working fluid from the connecting port of the access device. The output device connected to the access device is utilized to receive the working fluid from the access device and to output the working fluid. The third energizer provides a third energy to heat the working fluid passing through the access device and the output device.

The invention further provides an injection-head structure. The injection-head structure comprises a seat, a plurality of heads and a maintenance device. The heads are disposed on the seat and regulated between a first position and a second position. The maintenance device disposed next to the heads is utilized to position the heads between the first position and the second position.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the contemplated mode of carrying out the invention. This description is made for the purpose of illustrating the general principles of the embodiment and should not be taken in a limiting sense. The scope of the embodiment is best determined by reference to the appended claims.

Figure 1:
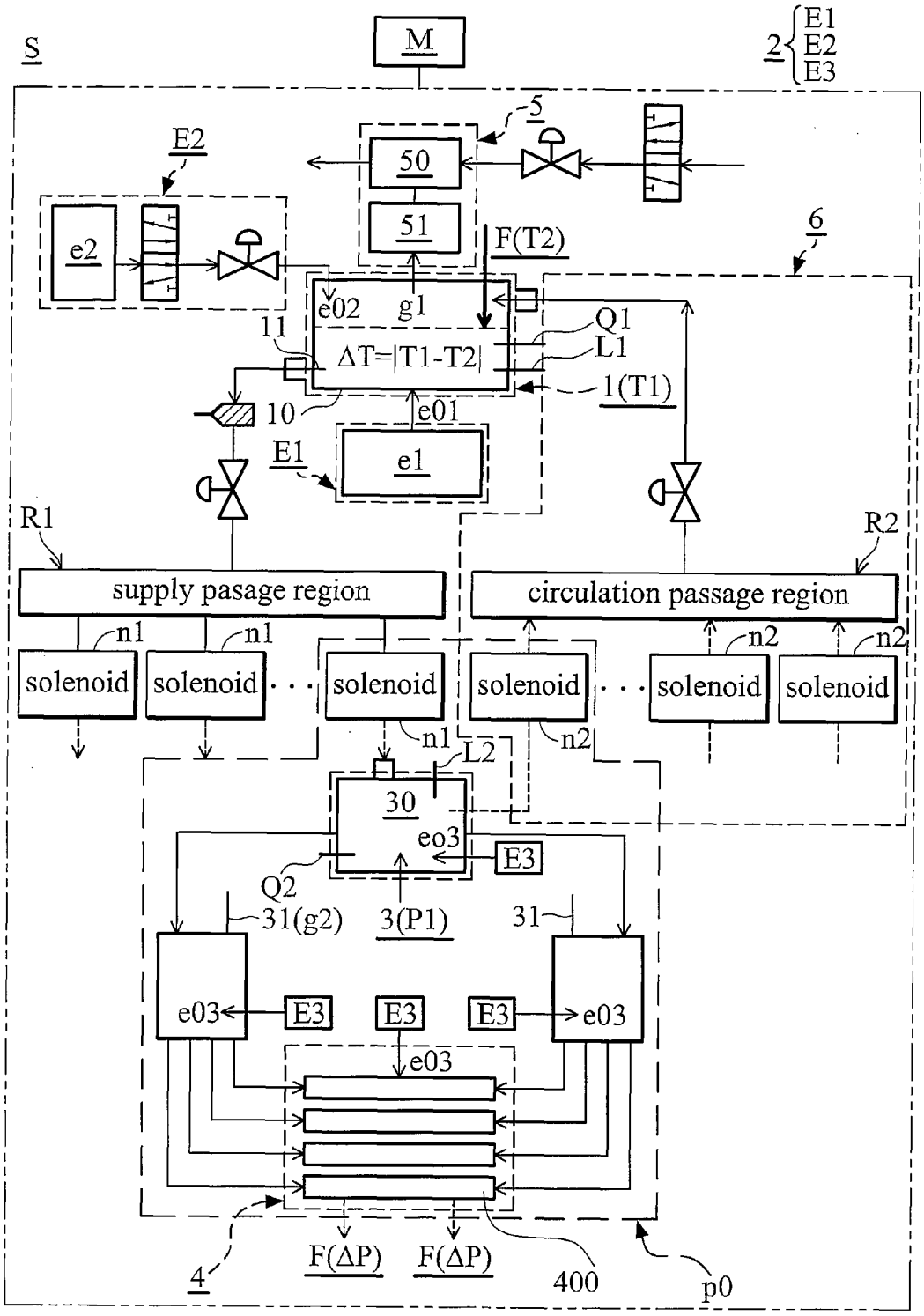
FIG. 1 is a schematic view of a configuration of a supply system of the embodiment.
Figure 2A:
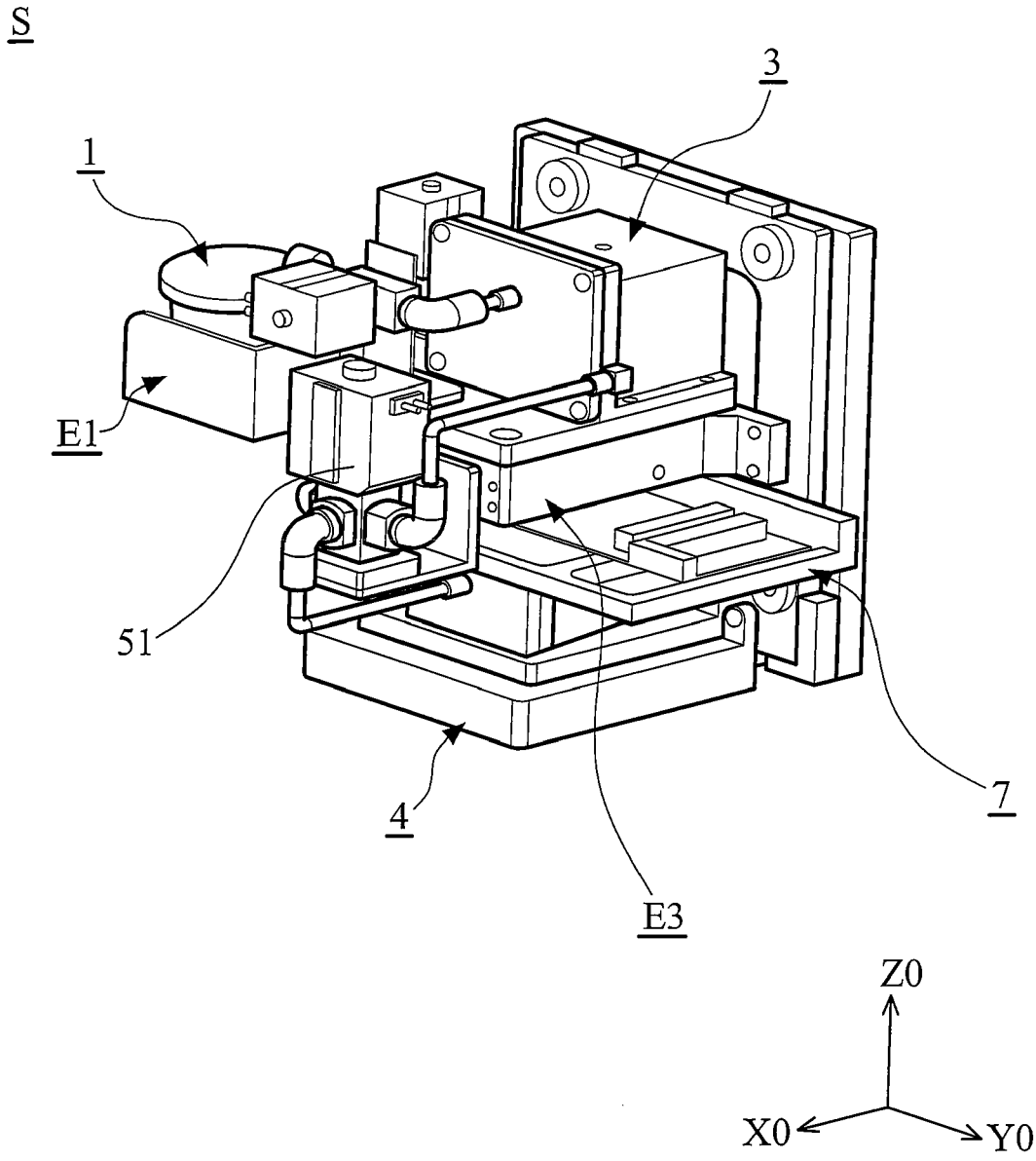
FIG. 2A is a perspective view of the supply system of the embodiment.
Figure 2B:
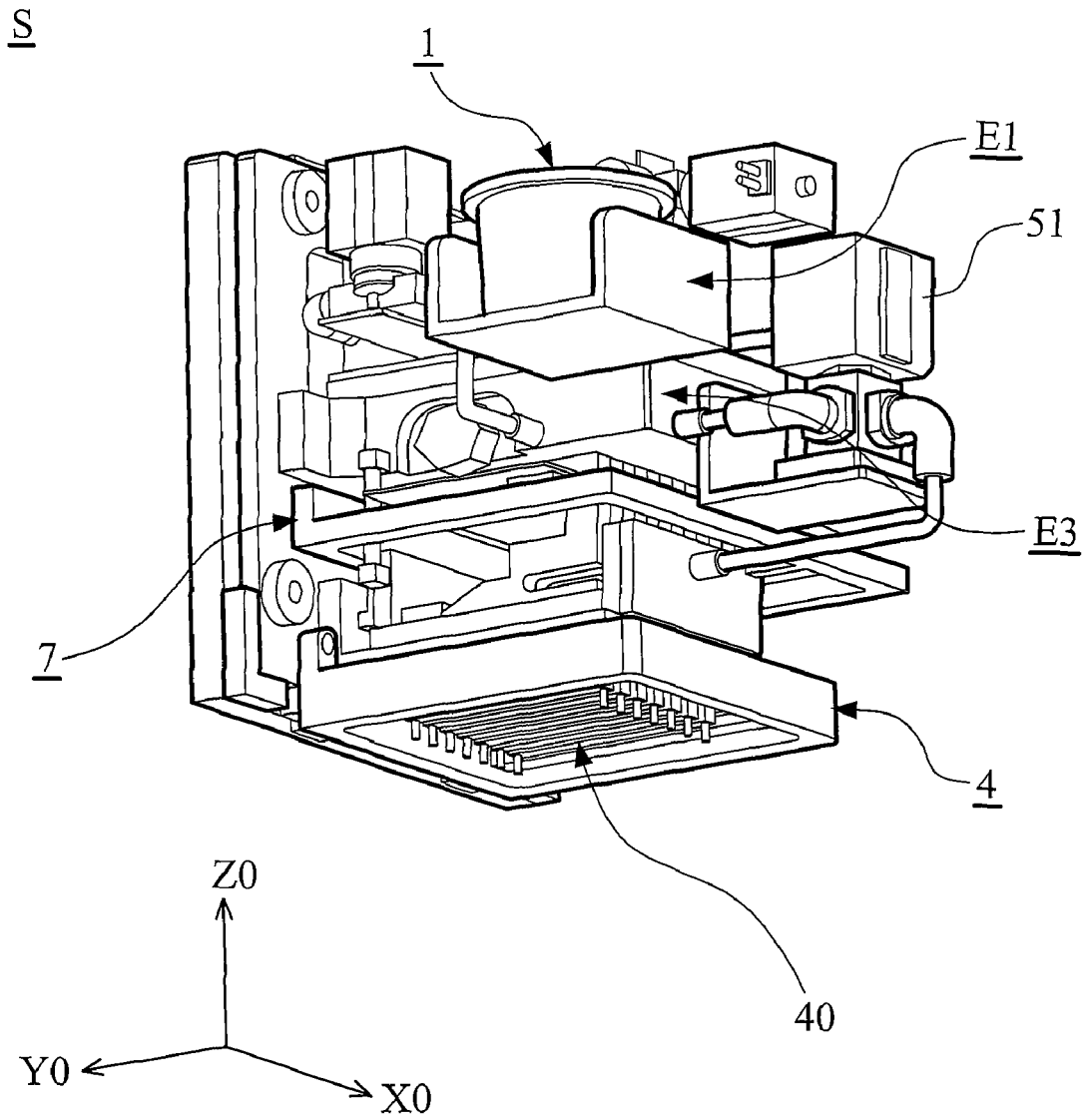
FIG. 2B is another perspective view of the supply system of the embodiment.

FIG. 1 is a schematic view of a configuration of a supply system S of the embodiment. FIG. 2A is a perspective view of the supply system S, and FIG. 2B is another perspective view of the supply system S. The supply system S is utilized to provide a working fluid F. In this embodiment, the supply system S is an ink supply system, and the working fluid F is an ink.

In FIGS. 1, 2A and 2B, the supply system S comprises an access device 1, an energy-increasing device 2, an intermediate device 3, an output device 4, a discharge device 5, a circulation device 6, a driving circuit 7, a monitoring device M, a plurality of level sensors L1/L2, and a plurality of temperature sensors Q1/Q2, e.g. a thermocouple.

In FIG. 1, the access device 1 utilized to access the working fluid F comprises a container 10 and a connecting port 11 connected the container 10. The container 10 connected to the connecting port 11 is utilized to access the working fluid F, and the working fluid F stored in the container 10 can be output via the connecting port 11. The temperature sensor Q1 and the level sensor L1 disposed on the container 10 are extended to the interior thereof. The temperature sensor Q1 is utilized to detect the interior temperature of the container 10, and the level sensor L1 is utilized to detect the level of the working fluid F in the container 10.

The energy-increasing device 2 comprises a first energizer E1, a second energizer E2 and a third energizer E3.

The first energizer E1 disposed next to the container 10 of the access device 1 provides a first energy e01 to energize the working fluid F stored in the access device 1 to expel bubbles from the working fluid F therein. In this embodiment, the first energizer E1 comprises a magnetic stirring heating device e1 provided with ultrasonic vibration, to provide the first energy e01 with thermal and kinetic heat energy, by stirring and vibrating the working fluid F of the access device 1.

Partially heated by the first energizer E1 of the working fluid F and measured by the temperature sensor Q1, the container 10 of the access device 1 has a first temperature T1, and the working fluid F externally input to the container 10 has a second temperature T2. When the working fluid F is injected into the container 10 of the access device 1, a temperature difference ΔT (ΔT=|T1−T2|) is formed between the first temperature T1 of the access device 1 and the second temperature T2 of the working fluid F. In this embodiment, the temperature difference ΔT ranges from 0° C. to the difference between a boiling point and a freezing point of the working fluid F, i.e., the temperature difference ΔT is not less than 0° C. Due to control of the temperature difference ΔT, drastic temperature fluctuations, the mixing of gas and liquid phases while the temperature of the working fluid F greater than the boiling point, and bubbles can be prevented.

The second energizer E2 comprises a pressure generating device e2 providing a second energy e02 to expel the working fluid F via the connecting port 11 of the access device 1. In this embodiment, the pressure generating device e2 provides the second energy e02 with pressure to transmit the working fluid F in the container 10 of the access device 1.

The output device 4 connected to the access device 1 is utilized to receive the working fluid F from the access device 1 and to output the working fluid F.

Figure 3:
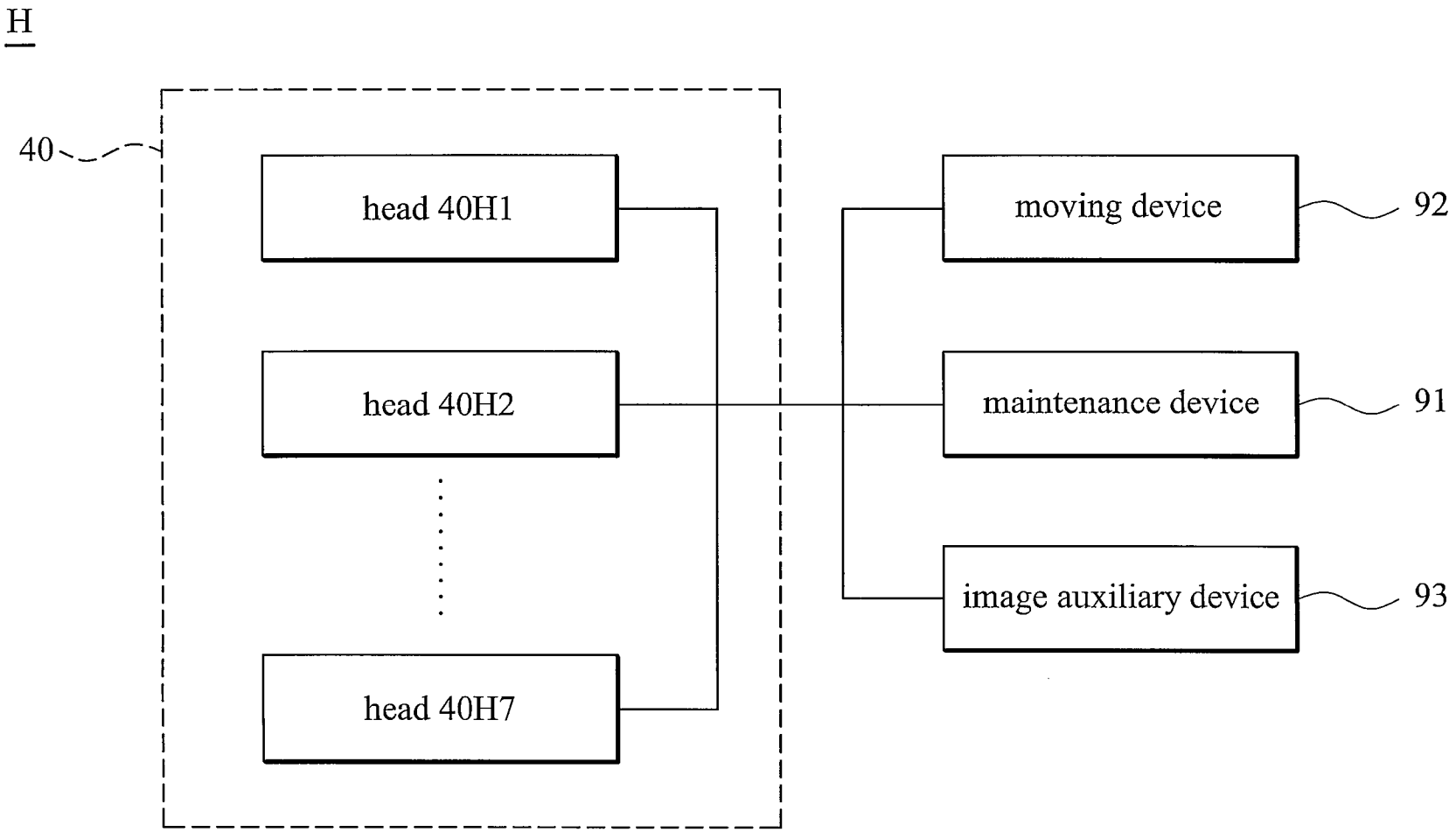
FIG. 3 is a configuration diagram of an injection-head structure of an output device of the embodiment.

The intermediate device 3 disposed between the access device 1 and the output device 4 is utilized to averagely distribute the working fluid F to a transient space of an injection-head structure H (see FIG. 3). Additionally, a supply passage region R1 and a plurality of solenoid valves n1 are sequentially disposed between the access device 1 and the intermediate device 3. The working fluid F coming from the access device 1 sequentially passes through the supply passage region R1 and the solenoid valves n1 and reaches the intermediate device 3, thus, to control the distributed working fluid F by the solenoid valves n1. In this embodiment, the solenoid valve n1 is a 3/2 CKD SUS316 seal PTFE solenoid valve.

The intermediate device 3 comprises a chamber 30 and a filtering unit 31. The chamber 30 is utilized to access the working fluid F from the supply passage region R1 and the solenoid valves n1. The filtering unit 31 is utilized to filter the bubbles g2 from the working fluid F of the chamber 30. The temperature sensor Q2 is utilized to detect the inner temperature of the chamber 30, and the level sensor L2 is utilized to detect the volume of the working fluid F of the chamber 30. In this embodiment, the filtering unit 31 is a permeable film. Specifically, the permeable film traps bubbles g2 when the working fluid F passes through the permeable film, i.e., there is no residual bubble in the working fluid F.

Note that the intermediate device 3 can produce a predetermined pressure p1, and the output device 4 is situated in an ambient pressure p0 which is less than the predetermined pressure p1, thereby utilizing a pressure difference ΔP (ΔP=p1−p0) of the ambient pressure p0 and the predetermined pressure p1 to drive the working fluid F located between the intermediate device 3 and the output device 4.

The third energizer E3 of the energy-increasing device 2 provides a third energy e03 to heat the working fluid F passing through the access device 1 and the output device 4.

The discharge device 5 connected to the access device 1 comprises an absorption unit 50 and a switch 51 disposed between the access device 1 and the absorption unit 50. The absorption unit 50 is connected to the access device 1 to absorb the bubbles g1 of the working fluid F coming from the container 10 of the access device 1. The switch 51, corresponding to the absorption unit 50, is utilized to open or close the pipe (not shown in the Figs.) located between the absorption unit 50 and the access device 1. In this embodiment, the switch 51 is an electromagnetic controlling switch 2-2 NC SV.

The circulation device 6 is disposed between the access device 1 and the intermediate device 3. Recirculation of the circulation device 6 is utilized to periodically or non-periodically transmit the bottom working fluid F of the chamber 30 of the intermediate device 3 to the container 10 of the access device 1, thereby forming a circulative mixing method to obtain an average concentration of the overall working fluid F. Further, with respect to the direction of recirculation of the working fluid F, a plurality of solenoid valves n2 and a circulation passage region R2 are sequentially disposed between the access device 1 and the intermediate device 3. The deposited working fluid F coming from the intermediate device 3 sequentially passes through the solenoid valves n2 and the circulation passage region R2 and reaches the access device 1, whereby, the distributed working fluid F is controlled by each solenoid valve n2. In this embodiment, the solenoid valve n2 is a 3/2 CKD SUS316 seal PTFE solenoid valve.

The third energy e03 of the third energizer E3 is utilized to heat at least one section where the working fluid F passes, thus, assuring that the working fluid F is provided with a required viscosity or temperature range.

The monitoring device M is utilized to perform monitoring of the temperature and pressure of the working fluid F, thus, eliminating problems associated with decreased temperature of the working fluid F due to heat dissipation, deterioration, and unstable supply flow.

In FIGS. 2A and 2B, the driving circuit 7 is electrically connected to the first energizer E1, the second energizer E2, the third energizer E3 and the output device 4. The driving circuit 7 electrically connected to the output device 4 drives the output device 4 to transmit the working fluid F and outputs the working fluid F via the injection-head structure H (see FIG. 3)

FIG. 3 is a configuration diagram of the injection-head structure H of the output device 4. The injection-head structure H comprises a head portion 40, a maintenance device 91, a moving device 92 and an image auxiliary device 93. The head portion 40 comprises a seat 40*b* (see FIG. 4A) and a plurality of heads. The maintenance device 91 comprises a solution (not shown in the Figs.) and at least one fastener 400*c* (see FIGS. 4A and 4B). The heads disposed on the seat 40*b* via the maintenance device 91 are controlled by the maintenance device 91, the moving device 92 and the image auxiliary device 93. The solution is utilized to fix the heads 40H1-40H7 to the seat 40*b*, and the fastener 400*c* is disposed between the seat 40*b* and at least one of the heads 40H1-40H7. In this embodiment, the fastener 400*c* comprises a plurality of screws, and the amount of the heads is seven, sequentially denoted by reference numbers 40H1-40H7.

Figure 4B:
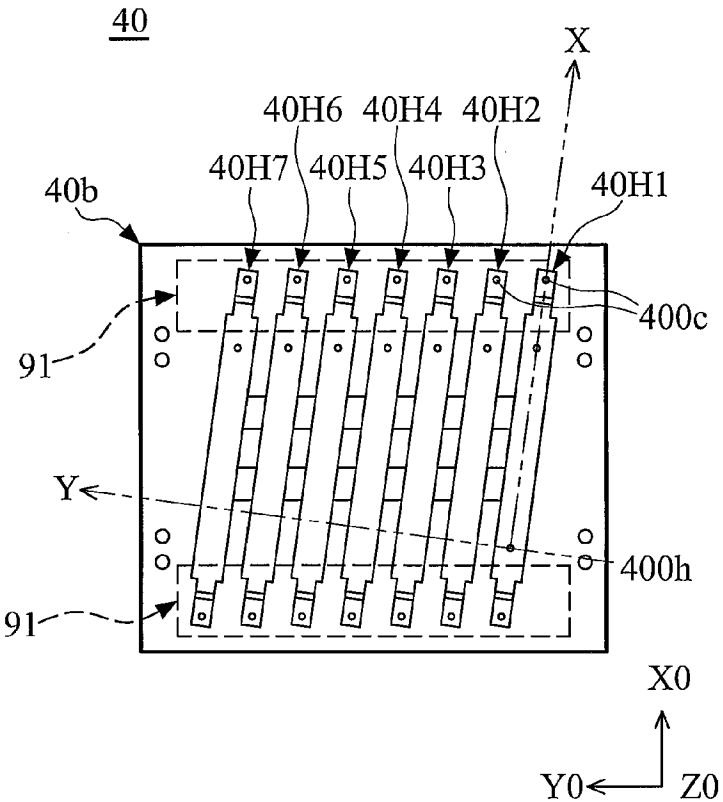
FIG. 4B is a plan view of the injection-head structure of the embodiment.
Figure 4A:
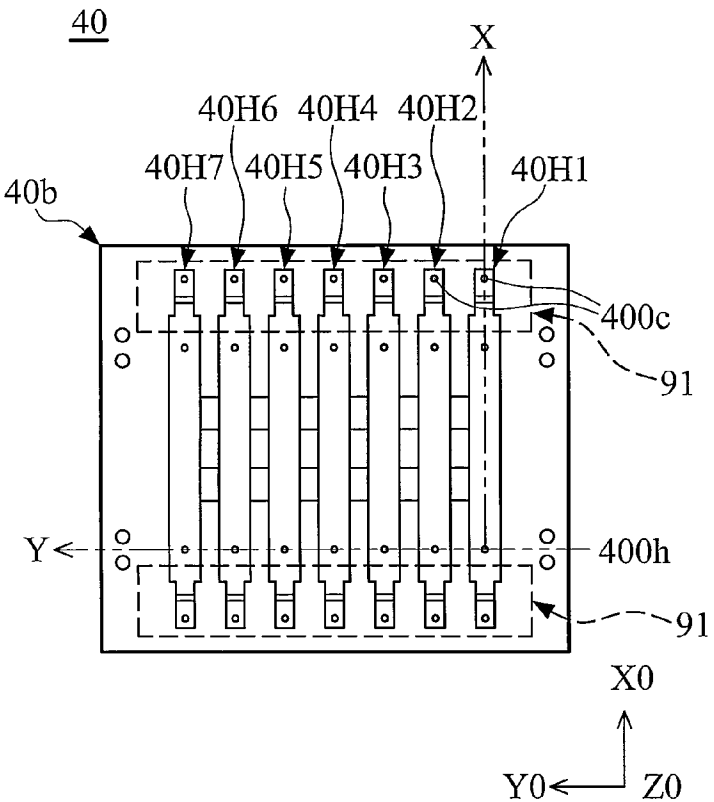
FIG. 4A is a plan view of the injection-head structure of the embodiment.

FIGS. 4A and 4B are plan views of the heads 40H1-40H7 located at different positions. The seat 40*b* is moved with respect to a first reference coordinate X0-Y0-Z0, and the heads 40H1-40H7 are regulated between a first position (shown in FIG. 4A) and a second position (shown in FIG. 4B) with respect to a second reference coordinate X-Y-Z different from the first reference coordinate X0-Y0-Z0. In this embodiment, the first reference coordinate X0-Y0-Z0 is defined as an absolute coordinate, the second reference coordinate X-Y-Z is defined as an incremental coordinate, and the heads 40H1-40H7 can be obliquely arranged with respect to the first reference coordinate X0-Y0-Z0.

In FIG. 3, the maintenance device 91 disposed next to the heads 40H1-40H7 is utilized to position the heads 40H1-40H7 located between the first position and the second position. The moving device 92 is utilized to move the heads 40H1-40H7 located between the first position and the second position. The image auxiliary device 93 is utilized to regulate the heads 40H1-40H7 located between the first position and the second position.

Figure 5A:
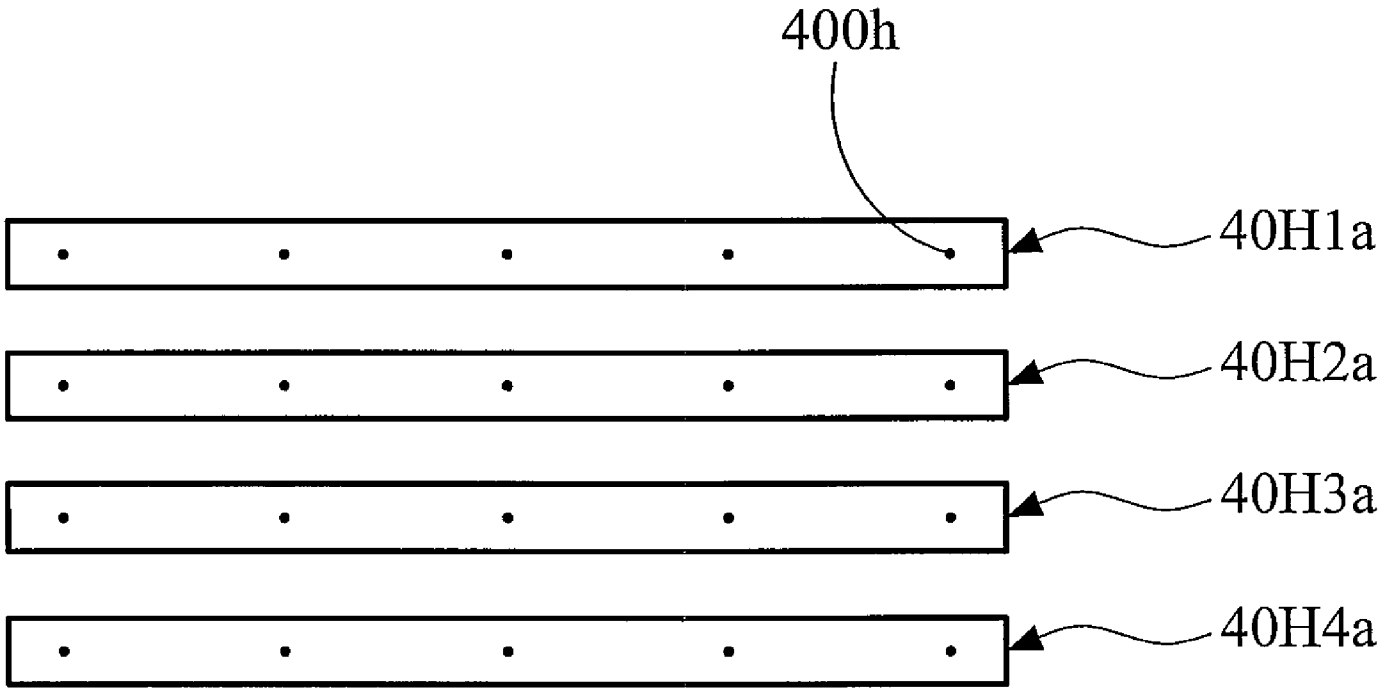
FIG. 5A is a plan view of another type of the heads of the embodiment.
Figure 5B:
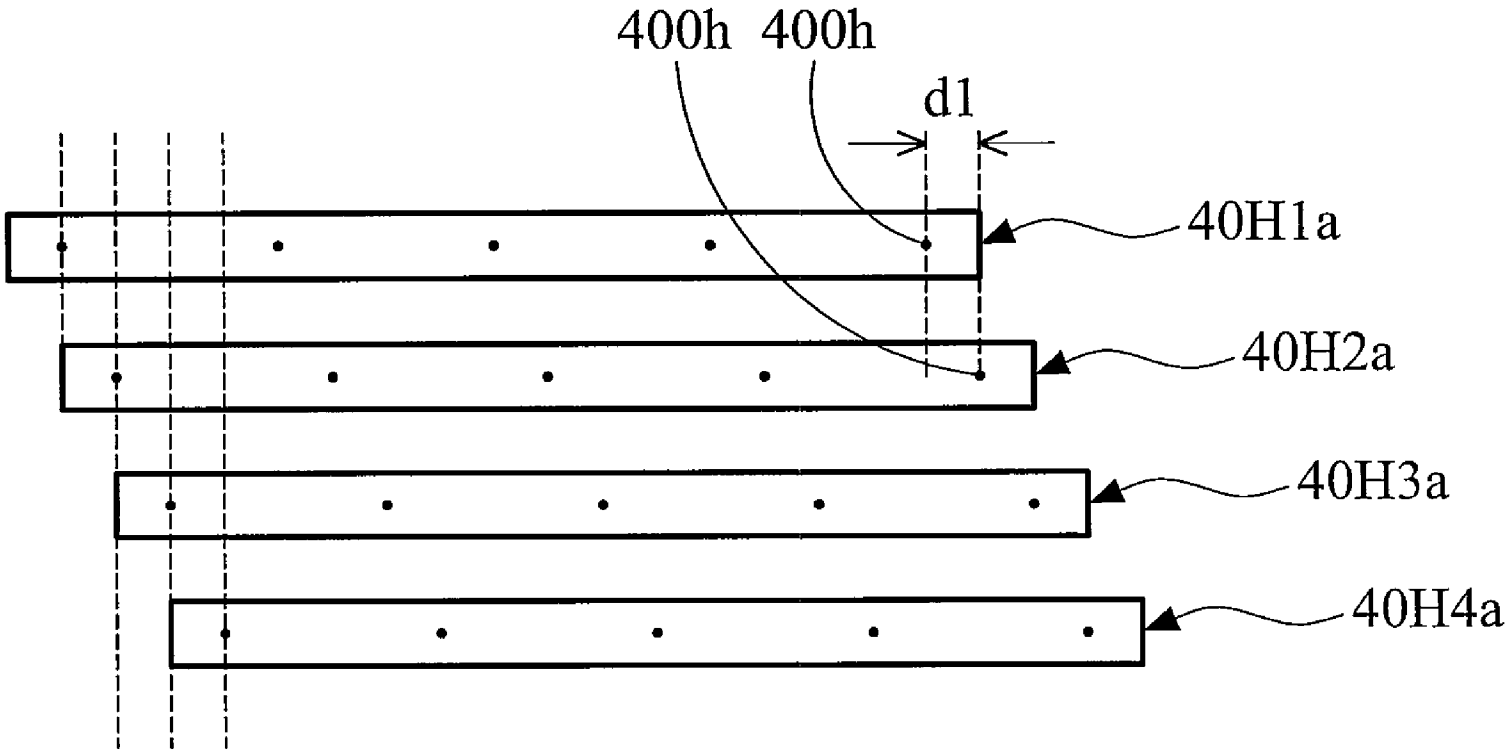
FIG. 5B is a plan view of another type of the heads of the embodiment.

FIGS. 5A and 5B are plan views of another type of the heads located at different positions. The amount of the heads is four, sequentially denoted by reference numbers 40H1*a*-40H4*a*. Each head 40H1*a*-40H4*a* comprises a plurality of injecting holes 400*h*. When the heads 40H1*a*-40H4*a* are moved from a first position (shown in FIG. 5A) to a second position (shown in FIG. 5B), dislocation with a distance d1 is presented among the injecting holes 400*h* of the heads 40H1*a*-40H4*a*.

Figures 6A, 6B:
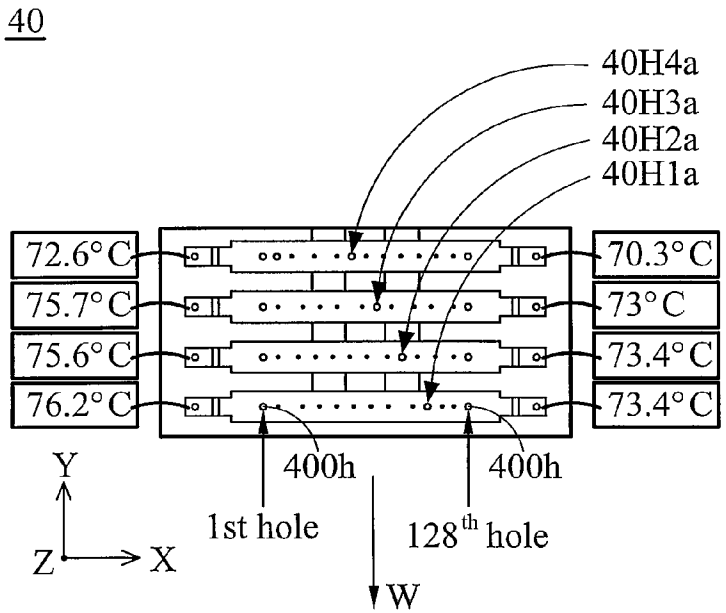
FIG. 6A is a schematic view of temperature distribution of the heads of FIG. 5A.
FIG. 6B is a dimensional variation measurement table of the heads of FIG. 6A after a predetermined heating period.

FIG. 6A is a schematic view of temperature distribution of the heads 40H1*a*-40H4*a* of FIG. 5A, and FIG. 6B is a dimensional variation measurement table of the heads 40H1*a*-40H4*a* of FIG. 6A after a predetermined heating period, e.g. one hour. In this embodiment, the amount of injecting holes 400*h* for each head 40H1*a*-40H4*a* is 128. To clearly specify the relationship of the injecting holes 400*h*, the leftmost hole 400*h* is defined as a $1^{st}$ hole, and the rightmost hole 400*h* is defined as a $128^{th}$ hole. Reference number x1 represents a dimensional variation of the $1^{st}$ hole of the heads 40H1*a*-40H4*a* with respect to an X axis of the second reference coordinate X-Y-Z, reference number y1 represents a dimensional variation of the $1^{st}$ hole of the heads 40H1*a*-40H4*a* with respect to a Y axis of the second reference coordinate X-Y-Z, reference number x128 represents a dimensional variation of the $128^{th}$ hole of the heads 40H1*a*-40H4*a* with respect to an X axis of the second reference coordinate X-Y-Z, and reference number y128 represents a dimensional variation of the $128^{th}$ hole of the heads 40H1*a*-40H4*a* with respect to a Y axis of the second reference coordinate X-Y-Z.

In FIG. 6B, according to the relationship of dimensional variation of the heads 40H1*a*-40H4*a*, it is shown that the dimensional variation from the head 40H1*a* to the head 40H4*a* is increasing. In other words, a thermal deformation for each head 40H1*a*-40H4*a* can be dimensionally compensated by the dislocated structure of the heads 40H1*a*-40H4*a*, i.e., thermal compensation.

According to the feature of the supply system S and design of the injection-head structure H of the described embodiments above, bubbles can be effectively removed, the working fluid F (such as ink) can be recycled, the working fluid F can be stably controlled, cleaning process can be performed by the pressurized working fluid F, and the residual bubbles g2 can be separated by absorption forces. Thus, an ideal quality and cleaning process can be attained and clogged heads can be prevented.

While the invention has been described by way of example and in terms of the embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A supply system utilized to provide a working fluid, comprising:

an access device utilized to access the working fluid, comprising a connecting port;

a first energizer providing a first energy to energize the working fluid stored in the access device, to expel bubbles from the working fluid, wherein the first energizer comprises a magnetic stirring heating device provided with ultrasonic vibration, to provide the first energy comprising thermal and kinetic energy, by stirring and vibrating the working fluid of the access device;

a second energizer providing a second energy to energize the working fluid stored in the access device, to expel the working fluid from the connecting port of the access device;

an output device connected to the access device, utilized to receive the working fluid from the access device and to output the working fluid; and a third energizer providing a third energy to heat the working fluid passing through the access device and the output device.

2. The supply system as claimed in claim 1 further comprising an intermediate device disposed between the access device and the output device, to access the working fluid expelled from the connecting port of the access device and to filter the working fluid.

3. The supply system as claimed in claim 2, wherein the intermediate device comprises a chamber utilized to access the working fluid expelled from the connecting port of the access device and a filtering unit utilized to filter the bubbles from the working fluid of the chamber.

4. The supply system as claimed in claim 3, wherein the filtering unit is a permeable film.

5. The supply system as claimed in claim 2 further comprising a circulation device disposed between the access device and the intermediate device, to transmit the working fluid of the intermediate device to the access device.

6. The supply system as claimed in claim 2, wherein the intermediate device produces a predetermined pressure and the output device is situated in an ambient pressure less than the predetermined pressure, utilizing a pressure difference of the ambient pressure and the predetermined pressure to drive the working fluid located between the intermediate device and the output device.

7. The supply system as claimed in claim 1, wherein the first energizer is disposed next to the access device.

8. The supply system as claimed in claim 1 further comprising a discharge device connected to the access device and utilized to absorb the bubbles from the working fluid of the access device.

9. The supply system as claimed in claim 8, wherein the discharge device comprises an absorption unit connected to the access device and a switch disposed between the access device and the absorption unit.

10. The supply system as claimed in claim 9, wherein the switch is an electromagnetic controlling switch.

11. The supply system as claimed in claim 1, wherein the second energizer comprises a pressure generating device providing the second energy with pressure, to transmit the working fluid of the access device.

12. The supply system as claimed in claim 2, wherein the output device comprises a head portion, and the working fluid is output from the head portion.

13. The supply system as claimed in claim 12, wherein the head portion of the output device comprises an injection-head structure, and the injection-head structure comprises a plurality of heads and a maintenance device, wherein the heads are aligned with respect to a reference axis, each head has a relatively movable coordinate system, the head is regulated with respect to the relatively movable coordinate system, and the regulated heads are positioned by the maintenance device.

14. The supply system as claimed in claim 1, wherein the third energizer is provided with the third energy comprising thermal energy, to heat the working fluid.

15. The supply system as claimed in claim 1 further comprising a monitoring device to monitor temperature and pressure of the working fluid.

16. The supply system as claimed in claim 1, wherein the access device has a first temperature and the working fluid has a second temperature, and a temperature difference is formed between the first temperature of the access device and the second temperature of the working fluid when the working fluid is injected into the access device.

17. The supply system as claimed in claim 16, wherein the temperature difference is not less than 0° C.

18. The supply system as claimed in claim 16, wherein the temperature difference is not greater than the difference between a boiling point and a freezing point of the working fluid.

19. The supply system as claimed in claim 1 further comprising a driving circuit electrically connected to the first energizer, the second energizer, the third energizer and the output device.

20. The supply system as claimed in claim 1, wherein the access device further comprises a container connected to the connecting port to access the working fluid.

21. The supply system as claimed in claim 1 further comprising a level sensor utilized to detect the level of the working fluid.

22. The supply system as claimed in claim 1 further comprising a temperature sensor (Q1/Q2) utilized to detect the temperature of the working fluid.

* * * * *